US008898959B2

(12) United States Patent
Montefusco et al.

(10) Patent No.: US 8,898,959 B2
(45) Date of Patent: Dec. 2, 2014

(54) SURFACE COVERINGS HAVING A PLURALITY OF OVERLAPPING ELEMENTS AND METHODS FOR FORMING SAME

(75) Inventors: James Montefusco, Keeseville, NY (US); Edward Kempisty, Plattsburgh, NY (US); Mark Smith, Plattsburgh, NY (US)

(73) Assignee: Swarovski Lighting, Ltd., Plattsburgh, NY (US)

( * ) Notice: Subject to any disclaimer, the term of this patent is extended or adjusted under 35 U.S.C. 154(b) by 27 days.

(21) Appl. No.: 13/619,383

(22) Filed: Sep. 14, 2012

(65) Prior Publication Data

US 2014/0075850 A1 Mar. 20, 2014

(51) Int. Cl.

| | |
|---|---|
| ***E04C 2/30*** | (2006.01) |
| ***F21V 1/14*** | (2006.01) |
| ***F21V 1/00*** | (2006.01) |

(52) U.S. Cl.

CPC ... *E04C 2/30* (2013.01); *F21V 1/14* (2013.01); *F21V 1/00* (2013.01)

USPC ..... 52/5; 362/153; 52/745.19

(58) Field of Classification Search

CPC ..... F21V 1/11; F21V 1/16; F21V 1/24; F21V 1/26; F21V 17/00; F21V 17/002; F21V 17/04; F21V 17/08

USPC ..... 52/3, 5; 362/123, 162, 225, 217.11, 362/217.15, 249.14–249.19; 63/33, 35; 428/211, 542.2–542.6

See application file for complete search history.

(56) References Cited

U.S. PATENT DOCUMENTS

| | | | | |
|---|---|---|---|---|
| 401,934 | A * | 4/1889 | D'Humy | 362/433 |
| D174,285 | S | 3/1955 | Katz | |
| 5,144,541 | A | 9/1992 | Schonbek | |
| 5,312,655 | A * | 5/1994 | Hultberg | 428/10 |
| 5,573,330 | A | 11/1996 | Lucas | |
| 5,577,838 | A | 11/1996 | Lucas | |
| 5,605,391 | A * | 2/1997 | Wood | 362/35 |
| D397,494 | S | 8/1998 | Bayer et al. | |
| D397,495 | S | 8/1998 | Bayer et al. | |
| D403,101 | S | 12/1998 | Bayer et al. | |
| 5,906,430 | A | 5/1999 | Bayer | |
| 5,921,668 | A * | 7/1999 | Bayer | 362/404 |
| D455,224 | S | 4/2002 | Yando | |
| D456,940 | S | 5/2002 | Yando | |
| D464,769 | S | 10/2002 | Bayer | |
| 6,592,706 | B1 * | 7/2003 | Malherbe de Juvigny et al. | 156/292 |

(Continued)

OTHER PUBLICATIONS

'Solar Ivy' Photovoltaic Leaves Climb to New Heights, designed by Brooklyn based SMIT (Sustainably Minded Interactive Technology), image available online on Dec. 26, 2012, at http://inhabitat.com/solar-ivy-photovoltaic-leaves-climb-to-new-heights/, 2-page, Jul. 2, 2009.

(Continued)

*Primary Examiner* — William Gilbert
*Assistant Examiner* — Kyle Walraed-Sullivan
(74) *Attorney, Agent, or Firm* — Heslin Rothenberg Farley & Mesiti P.C.

(57) ABSTRACT

A surface covering includes a frame, an element structure comprising an elongated member and a plurality of elements, and wherein spaced-apart portions of the elongated member being attachable to spaced-apart portions of the frame so that some of the elements are disposed in an overlapping relationship.

54 Claims, 12 Drawing Sheets

(56) References Cited

U.S. PATENT DOCUMENTS

| | | | | |
|---|---|---|---|---|
| D516,741 | S | 3/2006 | Schuyler et al. | |
| D517,241 | S | 3/2006 | Schuyler et al. | |
| D517,726 | S | 3/2006 | Schuyler et al. | |
| D517,727 | S | 3/2006 | Schuyler et al. | |
| D518,226 | S | 3/2006 | Schuyler et al. | |
| D518,227 | S | 3/2006 | Schonbek et al. | |
| D518,228 | S | 3/2006 | Schonbek et al. | |
| D521,678 | S | 5/2006 | Bayer | |
| D522,167 | S | 5/2006 | Bayer | |
| D522,168 | S | 5/2006 | Schuyler | |
| D522,169 | S | 5/2006 | Bayer | |
| D522,683 | S | 6/2006 | Bayer et al. | |
| D522,684 | S | 6/2006 | Schuyler et al. | |
| D522,685 | S | 6/2006 | Bayer | |
| D522,687 | S | 6/2006 | Bayer | |
| D523,169 | S | 6/2006 | Schuyler et al. | |
| D523,578 | S | 6/2006 | Schuyler et al. | |
| D523,579 | S | 6/2006 | Schuyler et al. | |
| D523,580 | S | 6/2006 | Schuyler et al. | |
| D523,988 | S | 6/2006 | Schuyler et al. | |
| D523,989 | S | 6/2006 | Bayer | |
| D524,476 | S | 7/2006 | Schuyler et al. | |
| 7,101,065 | B2 | 9/2006 | Bayer | |
| D532,144 | S | 11/2006 | Bayer et al. | |
| 7,225,851 | B2 | 6/2007 | Schonbek et al. | |
| 7,261,444 | B2 | 8/2007 | Bayer et al. | |
| 7,267,463 | B2 | 9/2007 | Bayer et al. | |
| D554,285 | S | 10/2007 | Schuyler | |
| D556,937 | S | 12/2007 | Ly | |
| D558,390 | S | 12/2007 | Myers et al. | |
| D560,019 | S | 1/2008 | Myers et al. | |
| D560,020 | S | 1/2008 | Ly | |
| D560,027 | S | 1/2008 | Bayer | |
| D560,306 | S | 1/2008 | Ly | |
| 7,347,594 | B2 | 3/2008 | Bayer et al. | |
| D566,327 | S | 4/2008 | Ly | |
| D570,536 | S | 6/2008 | Ly | |
| D577,145 | S | 9/2008 | Schonbek et al. | |
| D578,701 | S | 10/2008 | Schuyler et al. | |
| D580,089 | S | 11/2008 | Ly et al. | |
| D580,095 | S | 11/2008 | Ly | |
| D587,837 | S | 3/2009 | Schonbek et al. | |
| D588,295 | S | 3/2009 | Schonbek et al. | |
| D624,235 | S | 9/2010 | Forgette et al. | |
| D624,236 | S | 9/2010 | Recore et al. | |
| D626,683 | S | 11/2010 | Rabideau | |
| D626,684 | S | 11/2010 | Schuyler et al. | |
| 7,854,532 | B2 | 12/2010 | Myers et al. | |
| D634,472 | S | 3/2011 | Forgette et al. | |
| D636,519 | S * | 4/2011 | Rabideau et al. | D26/81 |
| D637,755 | S | 5/2011 | Rabideau et al. | |
| D655,856 | S | 3/2012 | Burks | |
| 8,128,259 | B2 | 3/2012 | Myers et al. | |
| 2008/0291662 | A1 * | 11/2008 | Barbieri | 362/123 |
| 2009/0003011 | A1 * | 1/2009 | Huang | 362/566 |
| 2011/0258832 | A1 | 10/2011 | Ly et al. | |
| 2012/0217363 | A1 | 8/2012 | Myers et al. | |

OTHER PUBLICATIONS

Solar Ivy Building-Integrated Modular Photovoltaic System Grows Bigger & Better, designed by Brooklyn based SMIT (Sustainably Minded Interactive Technology), image available online on Dec. 27, 2012, at http://inhabitat.com/solar-ivy-building-integrated-modular-photovoltaic-system-grows-bigger-better/, 1-page, Jun. 30, 2011.

Building Covered With Ivy, Lewis Family Photograph, image available online on Dec. 26, 2012, at http://lewisesinchina.blogspot.com/2008/06/tsingtao-home.html, 1-page, Jun. 19, 2008.

Ivy-Covered House in Oxford, photograph by Erik Hatch, image available online on Dec. 26, 2012, at http://blog.staticpeak.com/2011/09/favorite-photos-from-oxford.html, 1-page, Sep. 2, 2011.

Freitag Reference Handbag, manufactured by Freitag lab ag, Zurich, Switzerland, image available online on Dec. 26, 2012, at http://designoise.com/513/freitag-reference-limited-edition-of-hand-bags, 1-page, May 10, 2011.

The Little Mermaid—Julianne Moore and Michael Phelps, image available online on Dec. 26, 2012, at http://www.binarymoon.co.uk/2007/01/disney-ads/disney-little-mermaid-julianne-moore/, 1-page, 2008.

Brigitte Shelter, designed by Enrique Illanez Schoenenberger, image available online on Dec. 27, 2012, at http://mocoloco.com/fresh2/2011/01/19/brigitte-shelter-by-enrique-illanez-schoenenberger.php, 1-page, Jan. 19, 2011.

Shingle Plant, photograph by Tim Laman, image available online on Dec. 27, 2012, at http://www.nationalgeographicstock.com/ngsimages/explore/explorecomp.jsf?xsys=SE&id=759549, 1-page, Nov. 5, 2004.

3M_Dress-7-1, designed by Gensler, image available online on Dec. 27, 2012, at http://www.fastcodesign.com/1663754/materials-giant-3m-aims-to-elevate-its-brand-by-pushing-sexy-concepts-slideshow#1, 1-page, May 4, 2011.

DiscMail-Fashion, 1-page, designer and date unknown.

Bracher, U.S. Appl. No. 13/084,283, entitled "Light Fixtures, Methods of Suspending a Plurality of Light Sources, an Ornament Mounting, and a Method for Mounting an Ornament", filed Apr. 11, 2011.

Sigel, U.S. Appl. No. 13/084,296, entitled Crystal Mounting Frame and Light Assembly, filed Apr. 11, 2011.

Yando, U.S. Appl. No. 13/352,917 entitled "Crystal Mounting Frame and Light Assembly", filed Jan. 18, 2012.

Yando, Design U.S. Appl. No. 29/411,226, entitled "Chandelier", filed Jan. 18, 2012.

Yando, Design U.S. Appl. No. 29/426,830, entitled "Light Fixture Trim", filed Jul. 11, 2012.

* cited by examiner

SURFACE COVERINGS HAVING A PLURALITY OF OVERLAPPING ELEMENTS AND METHODS FOR FORMING SAME

FIELD OF THE INVENTION

This present disclosure relates generally to surface coverings, and more specifically, to surface coverings having a plurality of overlapping elements and methods for forming same.

BACKGROUND OF THE INVENTION

Surfaces are often covered with a covering. Surfaces such as products or structures are often covered for protection or decoration. For example, such coverings include coatings such as paint, and veneers such as a thin layer of wood or plastic.

There is a need for surface coverings having a plurality of overlapping elements and methods for forming same.

SUMMARY OF THE INVENTION

One aspect of the present disclosure is directed to a surface covering which includes a frame, an element structure comprising an elongated member and a plurality of elements, and wherein spaced-apart portions of the elongated member are attachable to spaced-apart portions of the frame so that some of the elements are disposed in an overlapping relationship.

Another aspect of the present disclosure is directed to an element structure which includes a monolithic structure comprising an elongated member integrally attached to a plurality of elements, and wherein the elongated member is disposable in a first configuration so that the elements are spaced apart from each other, and wherein the elongated member is disposable in a second configuration so that some of the elements are disposable in an overlapping relationship.

Another aspect of the present disclosure is directed to a method for forming a surface covering. The method includes providing a frame, providing an element structure comprising an elongated member attached to a plurality of elements, and attaching spaced-apart portions of the elongated member to spaced-apart portions of the frame so that some of the elements are disposed in an overlapping relationship Another aspect of the present disclosure is directed to a method for forming an element structure. The method includes forming a monolithic structure comprising an elongated member integrally attached to a plurality of elements disposed in a first configuration so that the elements are spaced apart from each other, and wherein the monolithic structure is disposable in a second configuration so that some of the elements are disposed in an overlapping relationship.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

In various aspects, the present disclosure is directed generally to surface coverings which may allow the ability to clad a form with overlapping elements. For example, as disclosed in greater detail below, a frame, framework, rafter-like structure, or support may be covered with a plurality of overlapping elements such as a scale-like or sequin-like covering or other overlapping covering. In addition, the overlapping elements may, for example, comprise a one-piece or monolithic part or structure that is cut from a flat material where the integrally formed and connected elements are disposed in side-by-side relationship. The clad form itself may define a structure or the clad form may be disposed on or connected to an underlying support. The surface covering may be flat, curved, or have any contoured surface, etc. The surface covering may be applied to or define any surface such for use in surface ornamentation in building or architectural settings, products such as light fixtures, and any other surface. The surface covering may include the entire surface covering may have elements in a contiguous overlapping relationship, or a portion of the surface covering having elements in a contiguous overlapping relationship. The present technique provides a cost effective manner for providing a surface covering having a specific effect while also concealing the fastenings and joining methods in the finished surface covering.

Figure 1:
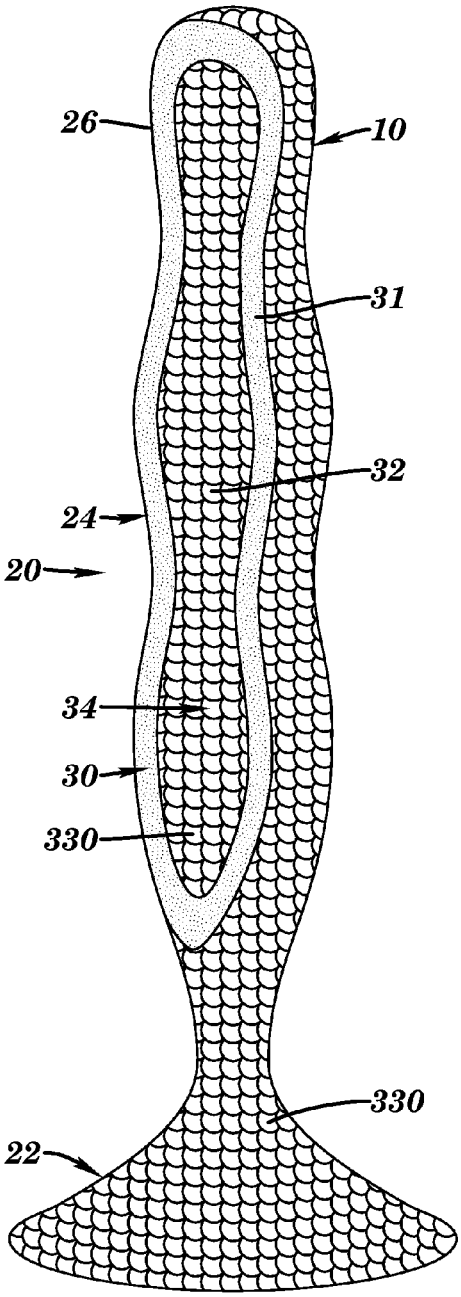
FIG. 1 is a front perspective view of one embodiment of a surface covering in accordance with aspects of the present disclosure configured as a lighting fixture.
Figure 2:
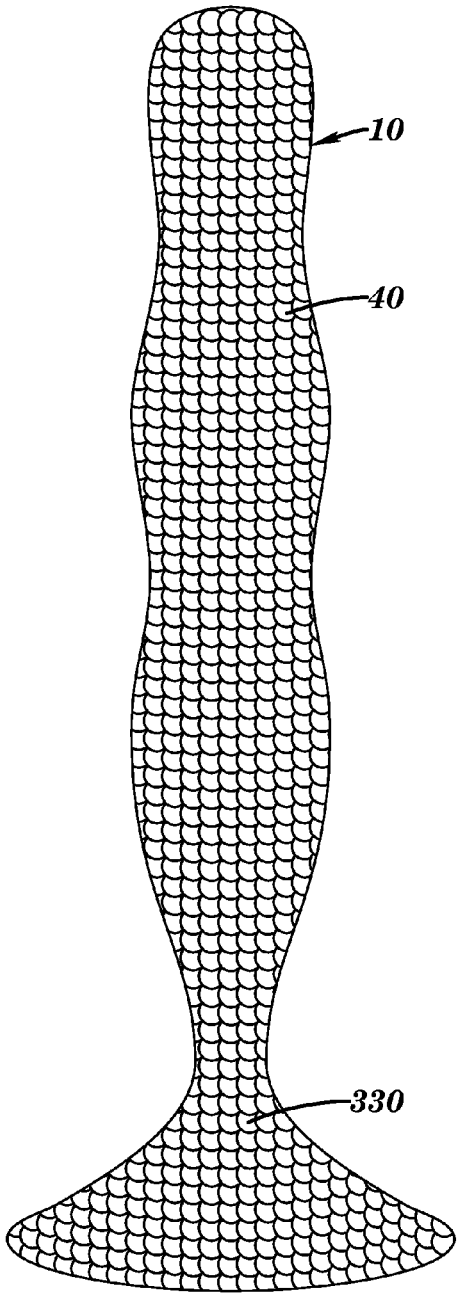
FIG. 2 is a rear perspective view of the surface covering of FIG. 1.

For purpose of illustration of the present technique for surface coverings, FIG. 1 illustrates one embodiment of a surface covering 10 in accordance with aspects of the present disclosure in the configuration of a lighting fixture. In this exemplary embodiment, surface covering 10 generally includes an elongated body 20 comprising a base or lower portion 22, a wavy or undulating middle portion 24, an upper portion 26, a front side 30 having a generally concave surface 32 defining a cavity 34. Front side 30 may include a flat covering member 31 which surrounds cavity 34. As shown in FIG. 2, surface covering 10 includes a rear side 40 having a generally curved convex surface. As shown in FIGS. 1 and 2, front side 30 (FIG. 1) and rear side 40 (FIG. 2) of surface covering 10 are covered with a plurality of overlapping elements 330. In one embodiment, the plurality of elements may be a plurality of partially overlapping circular discs which appear to cover and define the lighting fixture having a scale-like or sequin-like appearance. In this illustrated embodiment, surface covering may include portions that are entirely covered with overlapping elements such as the rear portion, the sides, the base, and the cavity. The covering is adaptable to large surface areas, such as the floor lamp shown in FIGS. 1 and 2 which may measure about 5 feet, 9 inches tall with a 2 foot diameter base.

Figure 3:
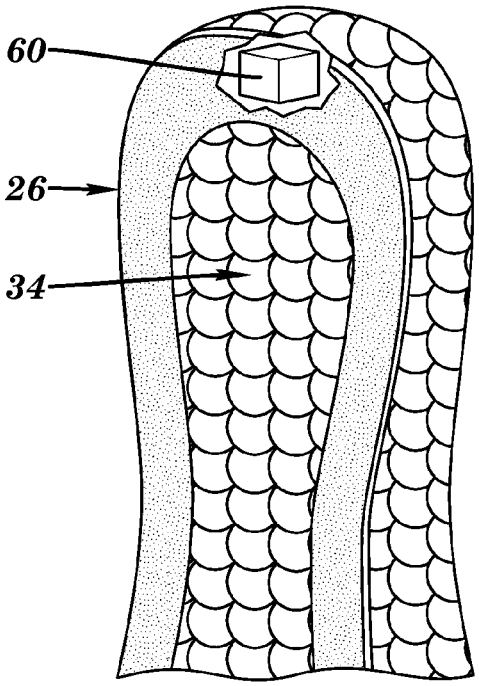
FIG. 3 is a partial front perspective view, partially cut away, illustrating a light source in an upper portion of the surface covering of FIG. 1.
Figure 4:
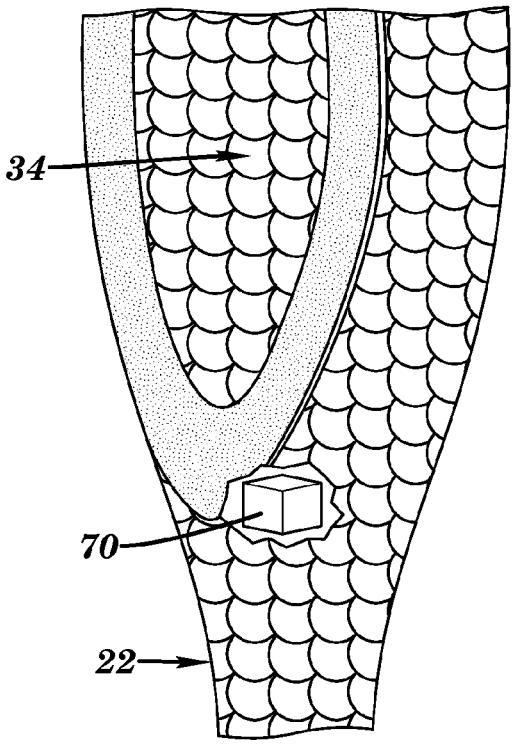
FIG. 4 is a partial front perspective view, partially cut away, illustrating a light source in a lower portion of the surface covering of FIG. 1.

As shown in FIG. 3, a light source 60 may be disposed in upper portion 26 for emitting light downwardly into cavity 34 and may be generally hidden from view when observed by an observer. As shown in FIG. 4, a light source 70 may be disposed in lower portion 22 for emitting light upwardly into cavity 34 and may also be generally hidden from view when observed by an observer. The light sources may be operably connected to an electrical supply such as an AC outlet. The light sources may be include light bulbs and/or one or more light emitting diodes. For example, the surface covering of FIG. 1 may include elements disposed in the cavity having a gold color while the elements disposed on the outside having a different color such black or brown.

Figure 5:
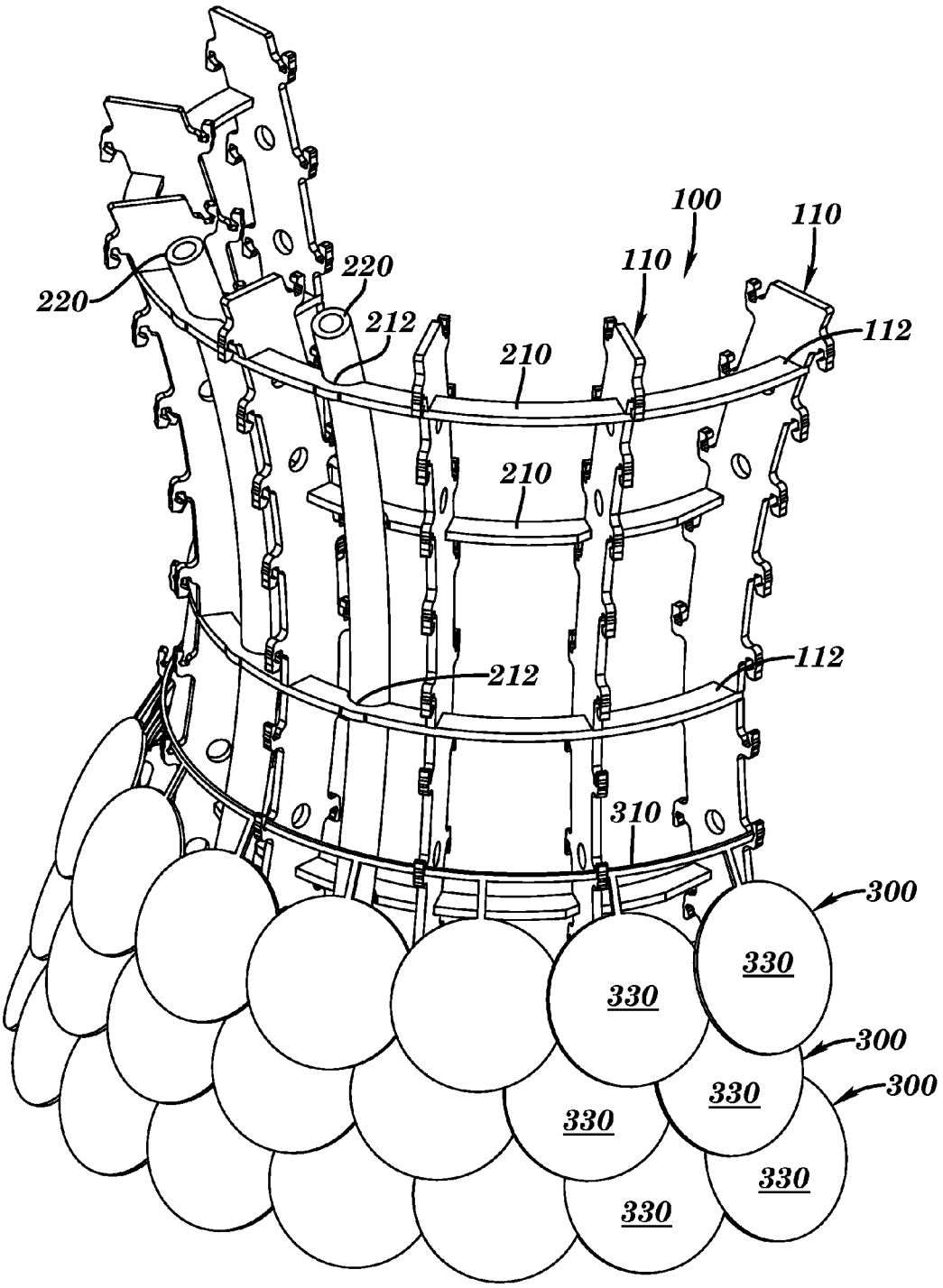
FIG. 5 is an enlarged perspective view of a portion of the surface covering of FIG. 1.

With reference to FIG. 5, the surface covering may generally comprise a frame 100 comprising a plurality of spaced-apart frame members 110, and a plurality of connecting spaced-apart rib members 210. For example, the frame members may be generally vertically disposed while the ribs may be generally horizontally disposed. Frame members 110 may include cutouts or slots 112 for receiving a portion of the rib members therein. The intersecting portions of the frame and ribs may be operably attached such as by welding, brazing, or soldering. Some of the rib members may be disposed on one side of the spaced-apart frame members, and other of the rib members may be disposed on the other side of the frame members. The inside portion of the ribs 210 may include a curved notch or cutout 212 for receiving and supporting a tube 220 through which an electrical cord may be disposed for electrically connecting an electrical power supply to the lighting source disposed in the upper portion of the surface covering. Frame members 110 support a plurality of element structures 300, which when an element structure containing the elements is applied to the frame, elements 330 are positioned to provide a plurality of overlapping elements 330.

Figure 6:
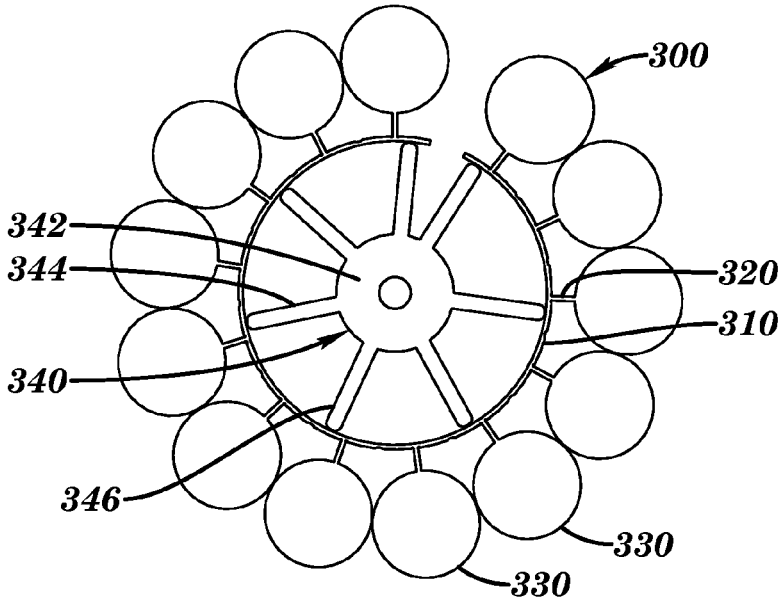
FIG. 6 is a plan view of an element structure having a planar configuration initially formed having a plurality of elements disposed along a curved elongated member around an inner support.
Figure 7:
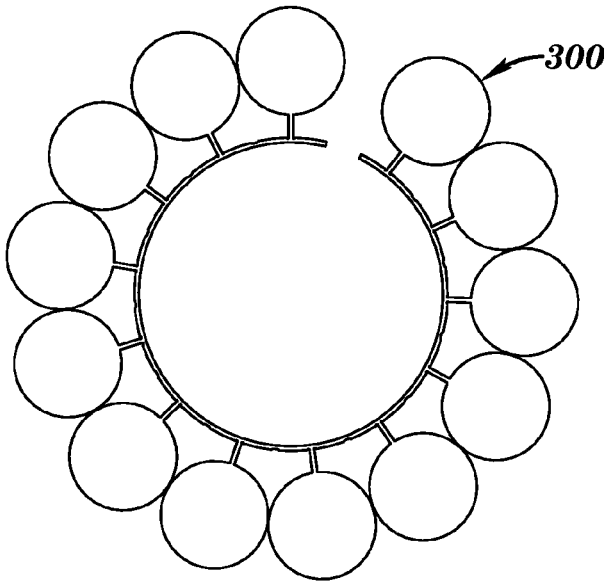
FIG. 7 is a plan view of the element structure of FIG. 6 with the inner support removed.
Figure 8:
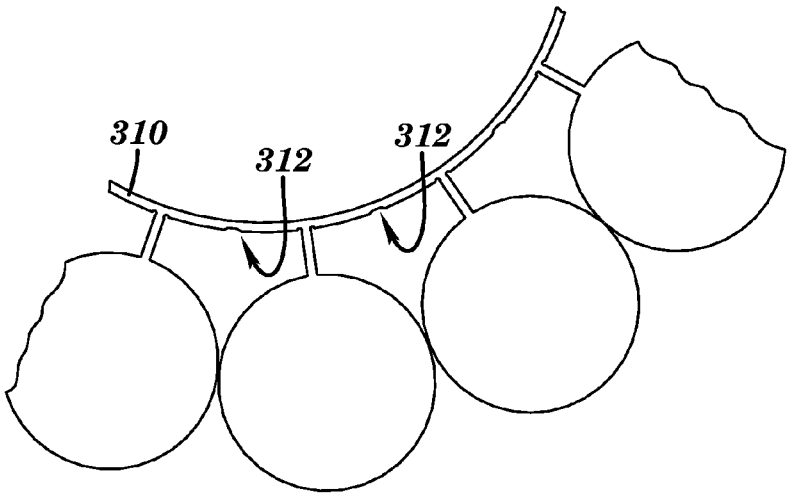
FIG. 8 is an enlarged view of a portion of the element structure of FIG. 7 showing the elongated member having a plurality of cutouts or notches.

As shown in FIG. 6, element structure 300 may be initially formed or laser cut from a monolithic planar sheet of material. For example, the formed or laser cut material may include element structure 300 having an elongated member 310 disposed in a circle. Outwardly extending from curved elongated member 310 is a plurality of spaced-apart branches 320 that attach to the plurality of spaced-apart elements 330. Adjacent elements 330 may be closely spaced together allowing an efficient use of the initial planar sheet of material. Disposed along the inside of elongated member 310 may be a support 340 having a circular member 342 with a plurality of arms or spokes 344, the ends 346 of which connect to elongated member 310. Support 340 may allow ease of manufacture by supporting the elongated member and the plurality of elements during forming, and subsequent processing such as coating of the elongated member and the plurality of elements. The ends 346 of spokes 344 may be disconnected from elongated member 310 to allow removal of support 340 from element structure 300 as shown in FIG. 7. With reference to FIG. 8, elongated member 310 may include a plurality of cutouts or notches 312 to allow elongated member 310 to be more easily bent or formed into other configurations.

Figure 9:
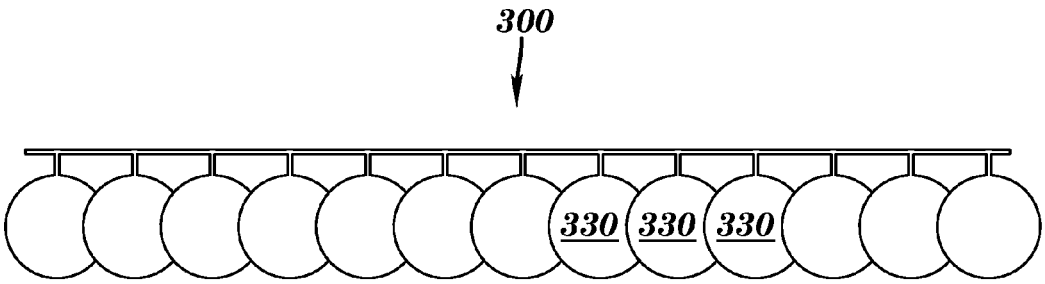
FIG. 9 is a view of the element structure of FIG. 8 wherein the elongated member is straightened.

As shown in FIG. 9, element structure 300 may be straightened generally so that portions of adjacent elements 330 overlap each other. For example, branches 320 may be slightly twisted so that elements 330 are rotated slightly so a portion of one element 330 overlaps a portion of an adjacent element 330. Straight elongated element structure 300 may be bent to have a curved configuration as shown in FIG. 5 for attaching to frame 100.

Figure 10:
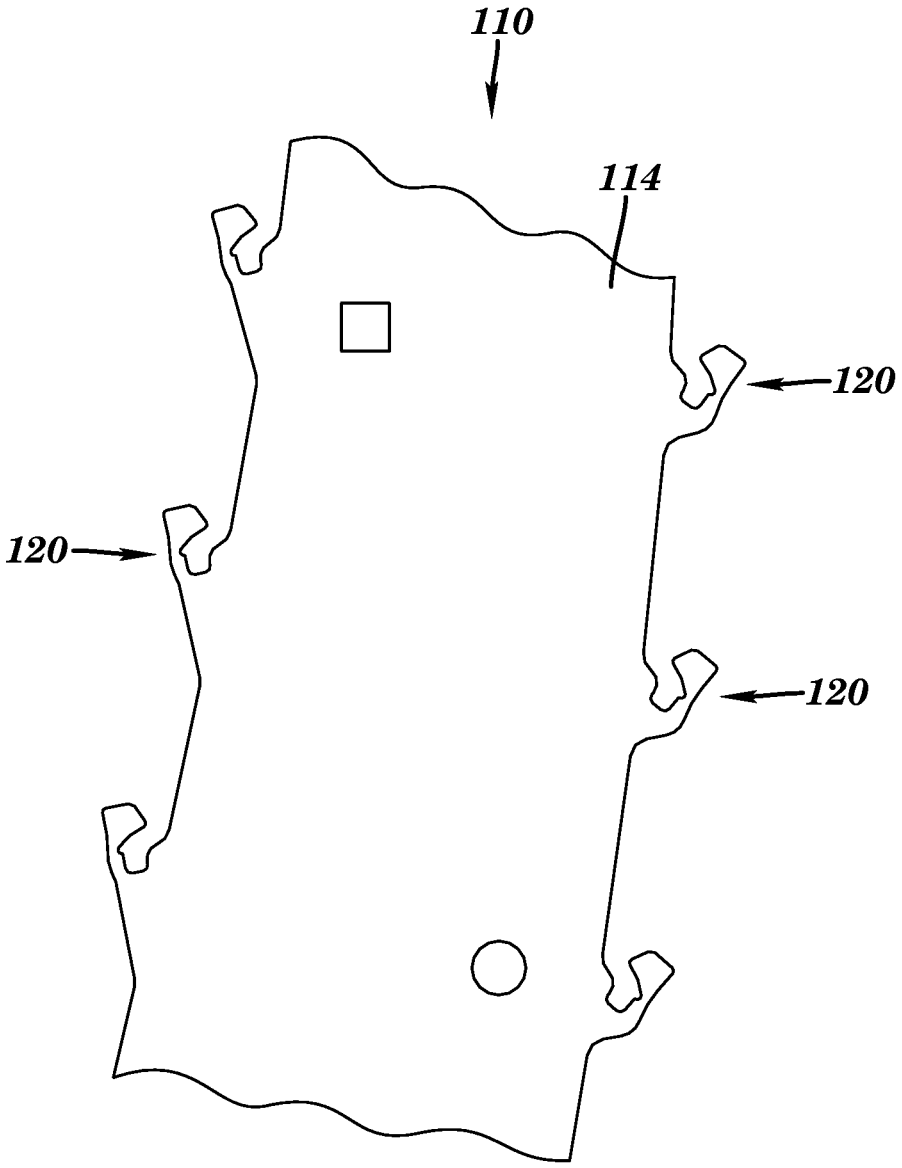
FIG. 10 is an enlarged view of a portion of the frame member of FIG. 5.

With reference to FIG. 10, frame member 110 includes an elongated portion 114 having a plurality of retaining members 120. For example, retaining members 120 may be spaced-apart and extend along opposite sides of elongated portion 114. Elongated portion 114 and retaining members 120 may be integrally formed and a portion of retaining member 120 may be bendable and deformable to secure the elongated member of the element structure to an edge of the frame member.

Figure 11:
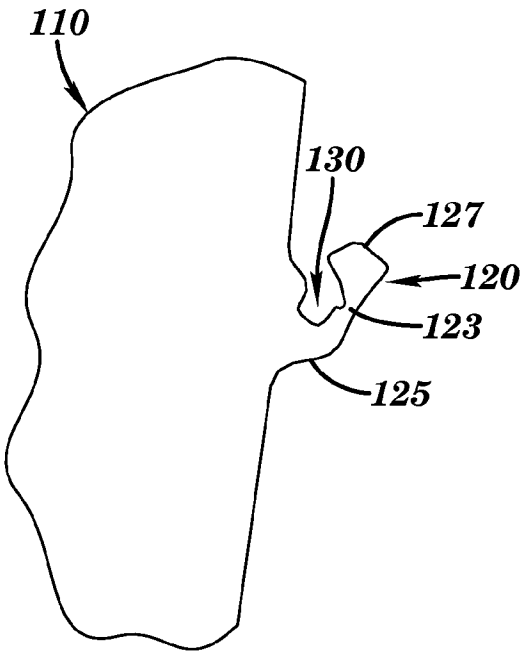
FIG. 11 is an enlarged side view of a portion of the frame member of FIG. 10 illustrating a retaining member.

As best shown in FIG. 11, retaining member 120 may include an outwardly-extending arm 125 defining a cavity 130 for receiving a portion of elongated member 310 (FIG. 5) of element structure 300 (FIG. 5). Arm 125 includes a reduced portion 123 and an enlarged end 127. The configuration of the frame member 110 shown in FIG. 11 is after being initially formed and prior to attachment to the element structure.

Figure 13:
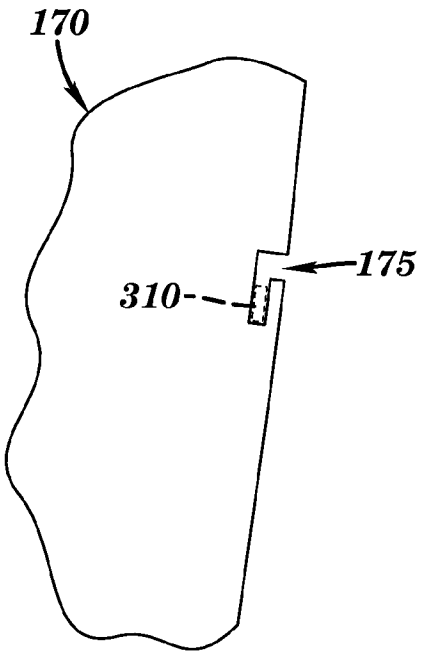
FIG. 13 is a side view of another embodiment of a portion of a frame member having an integral retainer for retaining the elongated member of the element structure.
Figure 12:
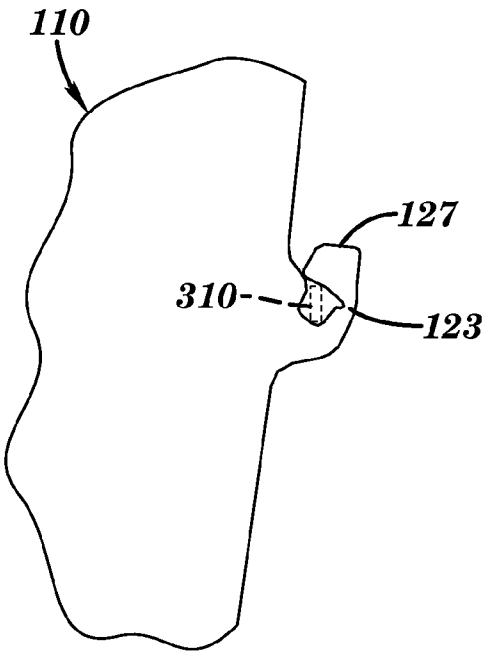
FIG. 12 is a side view of the portion of the frame member of FIG. 10 illustrating the retaining member deformed for retaining the elongated member of the element structure.

As shown in FIG. 12, reduced portion 123 may be deformed by bending enlarged end 127 inwardly over the cavity so that enlarged end 127 traps and retains the portion of elongated member 310 (shown in dashed lines) of the element structure. It will be appreciated that retaining member need not be deformed to support the element structure. While the retaining member may include an upwardly extending arm as shown in FIGS. 11 and 12, it will be appreciated that the retaining members may be configured to provide the arm disposed downwardly. While the retaining member is illustrated as having a generally U-shaped configuration, from the present description it will be appreciated that other configurations may be suitably employed. FIG. 13 illustrates another embodiment of a frame member 170 having cutout 175 operable for retaining a portion of elongated member 310 (shown in dashed lines) of the element structure.

The frame members may be formed from a single piece of material and the retaining members may be bendable. The frame members may be formed by any suitable method using materials such as metal or plastic. For example, the frame members may be cut by a laser from flat sheet metal such as sheet metal steel having a thickness of about 0.036 inch to about 0.074 inch, and having a thickness of about 0.040 inch (about 1 millimeter). In selecting the material of the frame members and their dimensions, the retaining members of the frame member are desirably bendable to permit secure attachment of the element structure. From the present description, it will be appreciated that the frame members need not be disposed in a single plane and may be disposed in more than one planes, or disposed on a curve or have other configurations depending on the geometry of the surface covering.

With reference again to FIG. 5, for example, the plurality of element structures may be installed by installing a first one and then installing then next subsequent row above the first one. Entire portions of the surface covering may be covered with overlapping elements.

Figure 14:
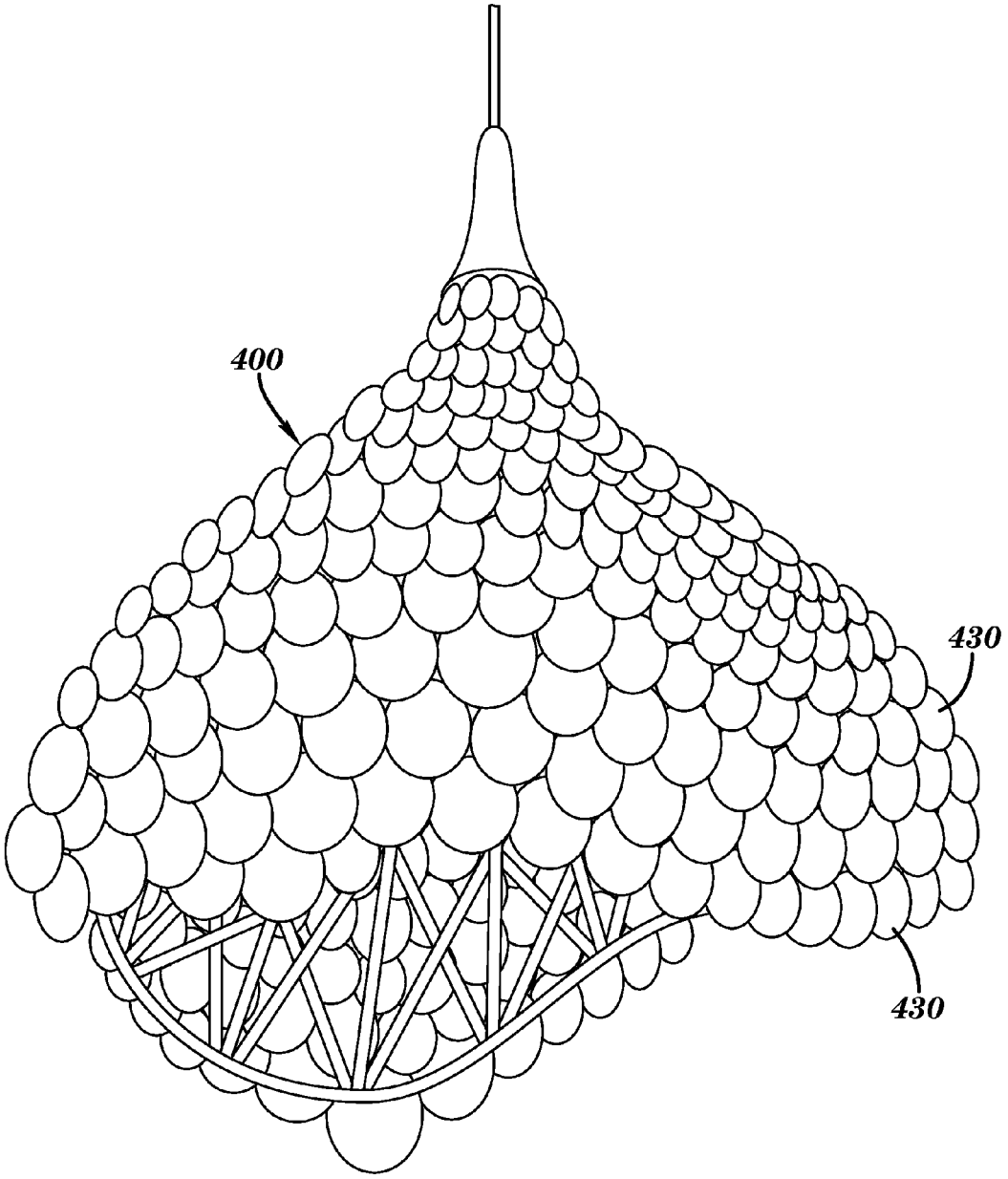
FIG. 14 is a perspective view of another embodiment of a surface covering in accordance with aspects of the present disclosure configured as a pendent lighting fixture.

FIG. 14 illustrates another embodiment of a surface covering 400 in accordance with aspects of the present disclosure in the configuration of a hanging pendent lighting fixture having a plurality of overlapping elements 430 disposed along an outside of the surface covering. The overlapping elements forming the outside may also result in the inside of the surface covering forming overlapping elements that may be observable to an observer.

Figure 15:
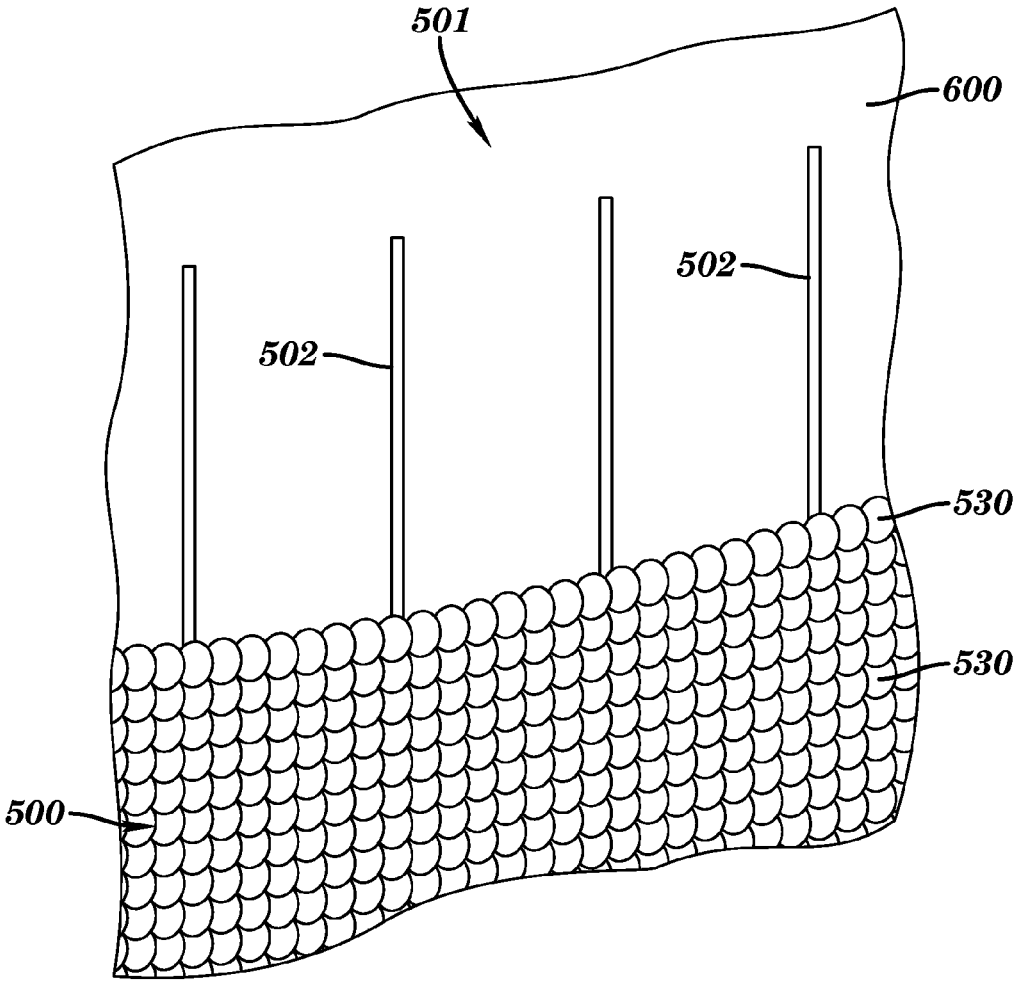
FIG. 15 is a perspective view of another embodiment of a surface covering in accordance with aspects of the present disclosure.

FIG. 15 illustrates another embodiment of a surface covering 500 in accordance with aspects of the present disclosure in the configuration such that the surface covering is attached to a support 600 such as a wall. A frame 501 may comprise a plurality of spaced-apart frame member 502 which may be operably attached to support 600. A plurality of element assemblies 530 may be attached to frame 501.

Figure 16:
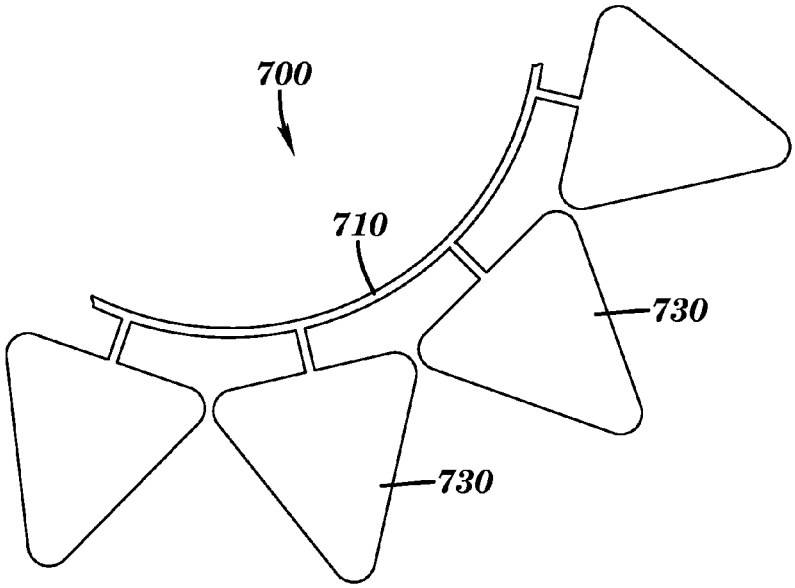
FIG. 16 is a plan view of another embodiment of a portion of the element structure in accordance with aspects of the present disclosure.
Figure 17:
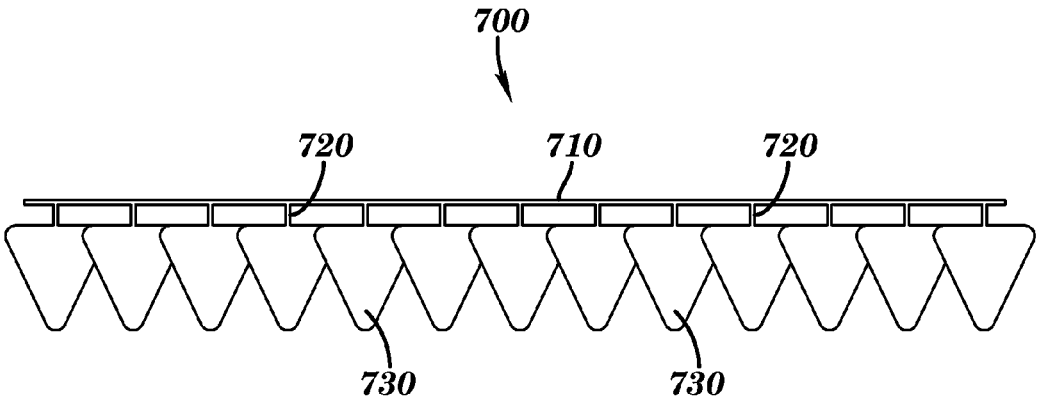
FIG. 17 is a view of the element structure of FIG. 16 wherein the elongated member is straightened.

FIG. 16 illustrates another embodiment of an element assembly 700 comprising and elongated member 710 attached to a plurality of generally rounded triangular-shaped elements 730. As shown in FIG. 16, the elements may be spaced apart when formed. As shown in FIG. 17, element structure 700 may be straightened generally so that portions of adjacent elements 730 overlap each other. For example, branches 720 may be slightly twisted so that elements 730 are rotated slightly so a portion of one element 730 overlaps a portion of an adjacent element 730. Straight elongated member 710 may also be bent to have a curved configuration into the plane of the drawing for attaching to a frame. In addition, the elongated member need not be straight but may have other configurations which still provide for overlapping elements.

Figure 18:
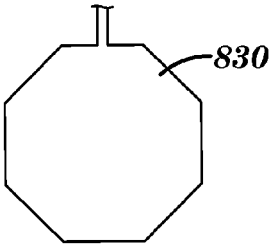
FIG. 18-20 are views of further embodiments of the elements for forming element structures in accordance with aspects of the present disclosure.
Figure 19:
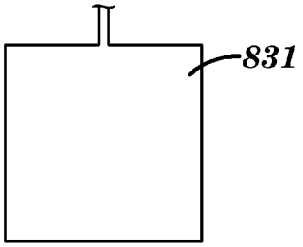
Figure 20:
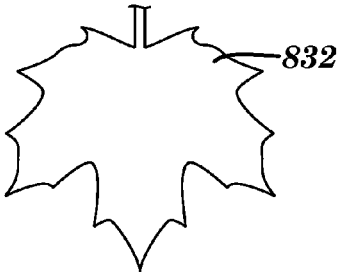

FIGS. 18-20 illustrate other shaped elements such as an octagonal-shaped element (FIG. 18), a square-shaped element 831 (FIG. 19), and a plant or leaf-shaped element 832 (FIG. 20). Elements in the form of leaves may provide a surface covering having an appearance of ivy. Furthermore, the elements may represent known or unknown shapes, and combination thereof. In addition, a plurality of differently shaped elements may be provided in a single element structure.

Figure 21:
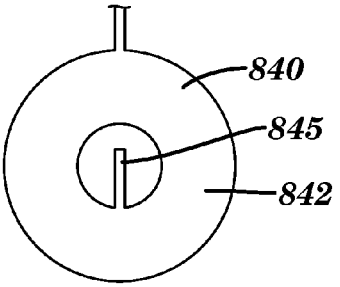
FIG. 21 is a view of another embodiment of an element for forming element structures in accordance with aspects of the present disclosure.
Figure 22:
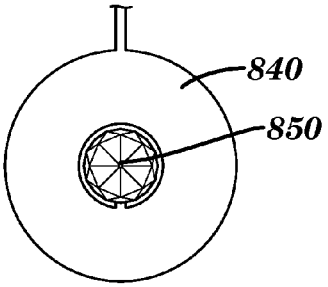
FIG. 22 is a view the element of FIG. 21 having a crystal attached to the element.

FIG. 21 illustrates an element 840 having a hollow portion 842, and a pin 845 that extends into the hollow portion. As shown in FIG. 22, a crystal 850 having a passageway therethrough may be supported on pin 845 (FIG. 21) and retained on element 840. One or more elements of the element structure may include for example a crystal. Alternatively, a crystal may be attached to a surface of the element with an adhesive or other suitable means. It will be appreciated that other types of ornamentation may be attached to the elements.

Figure 23:
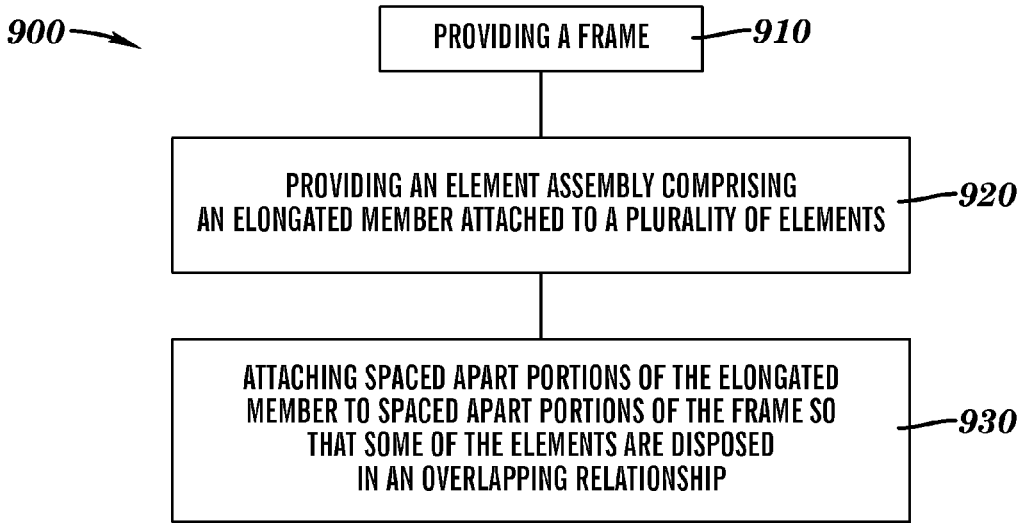
FIG. 23 is a flowchart illustrating a method for forming a surface covering in accordance with the aspects of the present disclosure.

FIG. 23 is a flowchart illustrating a method 900 for attaching a plurality of elements to a frame. The method includes at 910 providing a frame, and at 920 providing an element structure comprising an elongated member attached to a plurality of elements. At 930, spaced-apart portions of the elongated member are attached to spaced-apart portions of the frame so that some of the elements are disposed in an overlapping relationship.

Figure 24:
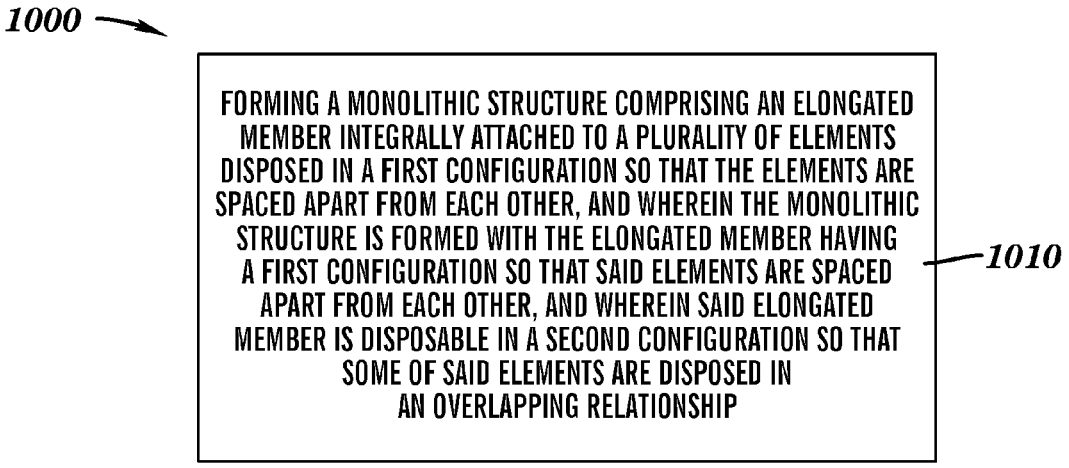
FIG. 24 is a flowchart illustrating a method for forming an element structure in accordance with the aspects of the present disclosure.

FIG. 24 is a flowchart illustrating a method 1000 for forming an element structure. The method includes at 1010 forming a monolithic structure comprising an elongated member integrally attached to a plurality of elements disposed in a first configuration so that the elements are spaced apart from each other, and wherein the monolithic structure is disposable in a second configuration so that some of said elements are disposed in an overlapping relationship.

From the present description, aspects of the present disclosure provide aesthetically pleasing surface coverings such as for lighting fixtures, walls, and other surfaces, and simplifies and facilitates assembly having a plurality of overlapping elements. For example, the present technique for forming a plurality of connected elements to an elongated member allows an assembler or manufacturer to readily and quickly assemble the plural of elements to the frame. As noted above, the elements may have any shape including for example, non-circular, triangular, square, rectangular, pentagonal, hexagonal, or other polygonal shape, oval, symmetric or non-symmetric, and be solid or having hollow or open portions therein, and may have the same or different colors and the same or different textured surfaces. The elements may all be the same size or shape or may include two or more different sizes and shapes.

The element assembly may be formed or cut from sheet metal, wood veneer, paper, a polymer-based material, one or more laminates, and/or any suitable material operable to allow the element assembly to be bent or configurable so that the elements are disposed in an overlapping relationship.

The plurality of elements may include ornaments attached to one or more of the elements. For example, the ornaments may be any conventional ornament, for example, a bead, a stone, or a crystal, for instance, a faceted or non-faceted crystal, for example, a sphere, a cube, a cone, a bar, a tube, a rod, a prism, a pear, and the like, or a square, rectangular, hexagonal, or octagonal crystal, among other shapes. The ornaments may also include a jewel, for example, a diamond, a ruby, a sapphire, or an opal, among others. The ornament may also not be a crystal, for example, the ornament may be a stone. The ornament may be made from any suitable material, for example, glass, wood, plastic, or metal, among others, and may be made from a transparent, a translucent, or an opaque material, for example, a colored glass.

From the present description, it will be appreciated that the present technique provides a surface covering having an organic shape such as a 3-dimensional shape with natural, less well-defined edges, such as, an amoeba, or a cloud, that may be manufactured utilizing laser cut sheet metal parts, instead of the standard method of forming molds for mold casting of the various parts. The surface covering is adaptable to large surface areas such as wall and other surfaces and may be 5 feet, 10 feet, 20 feet or larger in height and width.

Thus, while various embodiments of the present invention have been illustrated and described, it will be appreciated to those skilled in the art that many changes and modifications may be made thereunto without departing from the spirit and scope of the invention.

The invention claimed is:

1. A surface covering comprising:

a frame;

a monolithic element structure comprising an elongated member integrally attached to a plurality of elements; and said element structure being formed having a first substantially planar configuration with adjacent ones of said elements being spaced apart from each other, and wherein spaced-apart portions of said elongated member are attachable to spaced-apart portions of said frame with said element structure disposed in a second substantially non-planar configuration in which adjacent ones of some of said elements of said monolithic element structure are disposed in an overlapping relationship.

2. The surface covering of claim 1 wherein said element structure comprises a plurality of branches extending between said elongated member and said elements, and wherein said branches are twisted when said elongated member is attached to the frame so that said elements are disposed in the overlapping relationship.

3. The surface covering of claim 1 wherein said element structure comprises a plurality of element structures attached to spaced-apart portions of said frame.

4. The surface covering of claim 1 wherein said frame comprises a plurality of cavities for receiving a portion of said elongated member.

5. The surface covering of claim 1 wherein said frame comprises a plurality of spaced-apart frame members having a plurality of retaining members connectable to said element structure.

6. The surface covering of claim 5 wherein said plurality of retaining members comprises an arm defining a cavity for receiving a portion of the elongated member.

7. The surface covering of claim 6 wherein said arm is deformable to restrain a portion of the elongated member said cavity.

8. The surface covering of claim 1 wherein said frame comprises a plurality of spaced-apart frame members, said element structure comprises a plurality of element structures, and wherein the plurality of element structures are attachable to said plurality of frame members so that said plurality of elements define a contiguous extending covered surface.

9. The surface covering of claim 8 wherein said surface covering comprises an inwardly-extending surface covering.

10. The surface covering of claim 8 wherein said surface covering comprises an outer surface covering.

11. The surface covering of claim 1 wherein said frame comprises a plurality of spaced-apart frame members, said element structure comprises a plurality of element structures, and wherein the plurality of element structures are attachable to said plurality of frame members so that said plurality of elements define an inner surface covering and an outer surface covering.

12. The surface covering of claim 1 wherein said plurality of elements comprises a plurality of generally circular-shaped elements.

13. The surface covering of claim 1 wherein some of said plurality of elements comprises a hollow portion having a crystal disposed therein.

14. The surface covering of claim 1 wherein said element structure comprises metal.

15. The surface covering of claim 1 wherein said surface covering comprises at least a portion of a lighting fixture.

16. An element structure comprising:

a monolithic structure comprising an elongated member integrally attached to a plurality of elements; and wherein said element structure is disposable in a first substantially planar configuration so that adjacent ones of said elements are spaced apart from each other, and wherein said element structure is disposable in a second substantially non-planar configuration so that adjacent ones of some of said elements of said monolithic structure are disposable in an overlapping relationship.

17. The element structure of claim 16 wherein said first configuration comprises said elongated member disposed in a curve and said second configuration comprises said elongated member disposed in a line.

18. The element structure of claim 16 wherein said monolithic structure comprises a plurality of branches extending between said elongated member and said plurality of elements.

19. The element structure of claim 16 wherein said plurality of elements comprises a plurality of generally circular-shaped elements.

20. The element structure of claim 16 wherein some of said plurality of elements comprise a hollow portion having a crystal disposed therein.

21. A method for forming a surface covering, the method comprising:

providing a frame;

providing a monolithic element structure comprising an elongated member with a plurality of elements spaced-apart from each other, the element structure comprising a first substantially planar configuration; and attaching spaced-apart portions of the elongated member to spaced-apart portions of the frame so that the element structure is disposed in a second substantially non-planar configuration with adjacent ones of some of the elements disposed in an overlapping relationship.

22. The method of claim 21 wherein the element structure comprises a plurality of branches extending between the elongated member and the elements, and wherein the attaching comprises twisting the branches so that some of the elements are disposed in the overlapping relationship.

23. The method of claim 21 wherein the providing the element structure comprises providing a plurality of element structures, and the attaching comprises attaching the plurality of element structures so that some of the element structures are disposed in an overlapping relationship.

24. The method of claim 21 wherein the attaching comprises receiving portions of the elongated member in a plurality of cavities disposed in the frame.

25. The method of claim 21 wherein the providing the frame comprises providing the frame having a plurality of spaced-apart frame members having a plurality of retaining members connectable to the element structure.

26. The method of claim 25 wherein the plurality of retaining members comprises an arm defining a recess for receiving a portion of the elongated member.

27. The method of claim 26 wherein the attaching comprises deforming the arm to retain a portion of the elongated member in the recess.

28. The method of claim 21 wherein the providing the frame comprises providing the frame comprising a plurality of spaced-apart frame members, the providing the element structure comprises providing a plurality of element structures, and the attaching comprises attaching the plurality of element structures to the plurality of frame members.

29. The method of claim 28 wherein the surface covering comprises an inwardly-extending surface covering.

30. The method of claim 28 wherein the surface covering comprises an outer surface covering.

31. The method of claim 21 wherein the providing the frame comprises providing the frame having a plurality of spaced-apart frame members, the providing the element structure comprises providing the element structure having a plurality of element structures, and wherein the attaching comprises attaching the plurality of element structures to the plurality of frame members so that the plurality of elements define an inner surface covering and an outer surface covering.

32. The method of claim 21 wherein the plurality of elements comprises a plurality of generally circular-shaped elements.

33. The method of claim 21 wherein some of the plurality of elements comprise a hollow portion having a crystal disposed therein.

34. The method of claim 21 wherein the element structure comprises metal.

35. The method of claim 21 wherein the surface covering comprises at least a portion of a lighting fixture.

36. A method for forming an element structure, the method comprising:

forming a monolithic structure comprising an elongated member integrally attached to a plurality of elements with the monolithic structure disposed in a first substantially planar configuration so that adjacent ones of the elements are spaced apart from each other; and forming the monolithic structure in a second substantially non-planar configuration so that adjacent ones of some of the elements are disposed in an overlapping relationship.

37. The method of claim 36 wherein the forming comprises forming the monolithic structure comprising a plurality of branches integrally extending between the elongated member and the plurality of elements.

38. The method of claim 36 wherein the first configuration comprises the elongated member disposed in a curve and the second configuration comprises the elongated member disposed in a line.

39. The method of claim 36 wherein the forming comprising cutting the monolithic structure from a planar member.

40. The method of claim 36 wherein the plurality of elements comprises a plurality of generally circular-shaped elements.

41. The method of claim 36 wherein some of the plurality of elements comprise a hollow portion having a crystal disposed therein.

42. A method for forming a surface covering, the method comprising:

providing a frame;

providing an element structure comprising an elongated member attached to a plurality of elements with a plurality of branches extending between the elongated member and the elements; and attaching spaced-apart portions of the elongated member to spaced-apart portions of the frame and twisting the branches so that some of the elements are disposed in an overlapping relationship.

43. The method of claim 42 wherein the providing the element structure comprises providing a monolithic structure comprising the elongated member integrally connected to the plurality of elements.

44. The method of claim 42 wherein the providing the element structure comprises providing a plurality of element structures, and the attaching comprises attaching the plurality of element structures so that some of the element structures are disposed in an overlapping relationship.

45. The method of claim 42 wherein the attaching comprises receiving portions of the elongated member in a plurality of cavities disposed in the frame.

46. The method of claim 42 wherein the providing the frame comprises providing the frame having a plurality of spaced-apart frame members having a plurality of retaining members connectable to the element structure.

47. The method of claim 46 wherein the plurality of retaining members comprises an arm defining a recess for receiving a portion of the elongated member.

48. The method of claim 47 wherein the attaching comprises deforming the arm to retain a portion of the elongated member in the recess.

49. The method of claim 42 wherein the providing the frame comprises providing the frame comprising a plurality of spaced-apart frame members, the providing the element structure comprises providing a plurality of element structures, and the attaching comprises attaching the plurality of element structures to the plurality of frame members.

50. The method of claim 49 wherein the surface covering comprises an inwardly-extending surface covering.

51. The method of claim 49 wherein the surface covering comprises an outer surface covering.

52. The method of claim 42 wherein the plurality of elements comprises a plurality of generally circular-shaped elements.

53. The method of claim 42 wherein some of the plurality of elements comprise a hollow portion having a crystal disposed therein.

54. The method of claim 42 wherein the surface covering comprises at least a portion of a lighting fixture.

* * * * *